United States Patent [19]

Mullins

[11] Patent Number: 4,780,800

[45] Date of Patent: Oct. 25, 1988

[54] REFLECTIVE LOUVRE FOR CEILING FIXTURES

[75] Inventor: Jack R. Mullins, Missouri City, Tex.

[73] Assignee: J. W. Lighting, Inc., Houston, Tex.

[21] Appl. No.: 859,707

[22] Filed: May 5, 1986

[51] Int. Cl.[4] ..... F21V 7/12

[52] U.S. Cl. ..... 362/342; 362/290

[58] Field of Search ..... 362/279, 290, 297, 342, 362/346, 347

[56] References Cited

U.S. PATENT DOCUMENTS

| | | | |
|---|---|---|---|
| Des. 274,657 | 7/1984 | Herst et al. | D26/76 |
| 3,123,310 | 9/1961 | Dameral | 362/221 |
| 3,158,327 | 9/1961 | Dameral | 362/260 |
| 3,214,580 | 12/1962 | Dameral | 362/219 |
| 3,364,348 | 1/1968 | Dameral | 362/221 |
| 4,268,897 | 5/1981 | Schierwagen et al. | 362/325 |
| 4,390,930 | 6/1983 | Herst et al. | 362/224 |
| 4,420,798 | 12/1983 | Herst et al. | 362/147 |
| 4,429,354 | 1/1984 | Garnett | 362/342 |

FOREIGN PATENT DOCUMENTS

| | | | |
|---|---|---|---|
| 3034892 | 4/1982 | Fed. Rep. of Germany | 362/342 |

OTHER PUBLICATIONS

The Day-Brite Brochure Entitled "Paralouver II-2'X4' With 32 Cells", Publication No. SEC 25-33.

The "Alumapar" Catalogue by the A.L.P. Lighting and Ceiling Products, Inc.

Publication Nos. SEC 25-71; SEC 25-75; and SEC 25-77, all from the Day-Brite Lighting Division of Emerson Electric Co.

"Ultrapar 9040 Series" Catalogue, Published by Globe Illumination Company.

Publication Entitled "Para3HREE The Ultimate Dimension", by the Crouse-Hinds Lighting Company.

The "Paramax Parabolic Grid Troffer", Brochure No. 2PMG 340-18.

The "Paramax Beta", Brochure No. 2PM3 340.

"Premium Quality Recess Fixture Family", Day-Brite Lighting Division of Emerson Electric Company.

"Paralux", Paralux Corporation, a division of Metalux.

Day-Brite Brochure No. SEC 25-73.

Publication entitled "Paralux III" of the Paralux Corporation.

*Primary Examiner*—Samuel Scott

*Assistant Examiner*—Allen J. Flanigan

*Attorney, Agent, or Firm*—Arnold, White & Durkee

[57] ABSTRACT

An improvement in reflective louvres for lighting fixtures is disclosed. The improvement is directed toward a means to interlock the louvre components together so as to create a tight fitting, uniform seam at the junction of the various components. The present invention is particularly suitable for use with louvres having reflective parabolic or other curved surfaces. The present invention maximizes the reflective capability of the louvre while presenting a more aesthetically pleasing lighting fixture. Further, a louvre according to the present invention is easy to assemble and requires a minimal amount of labor in assembly.

16 Claims, 3 Drawing Sheets

Fig.1
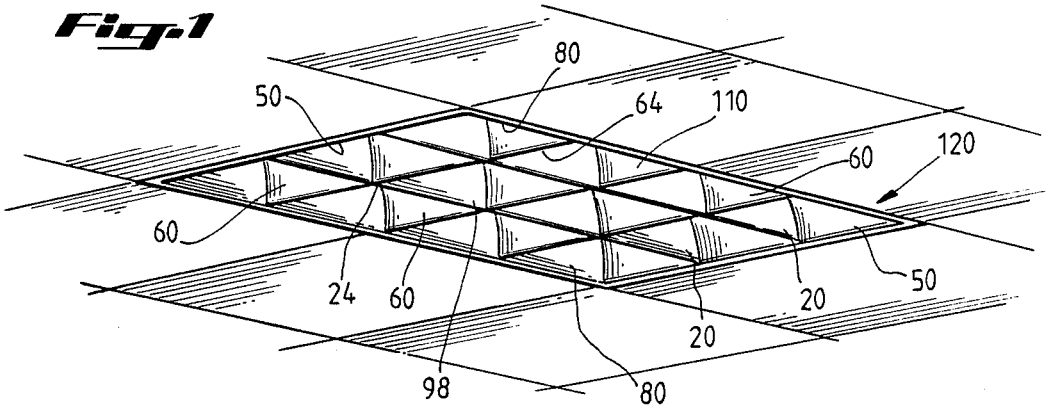
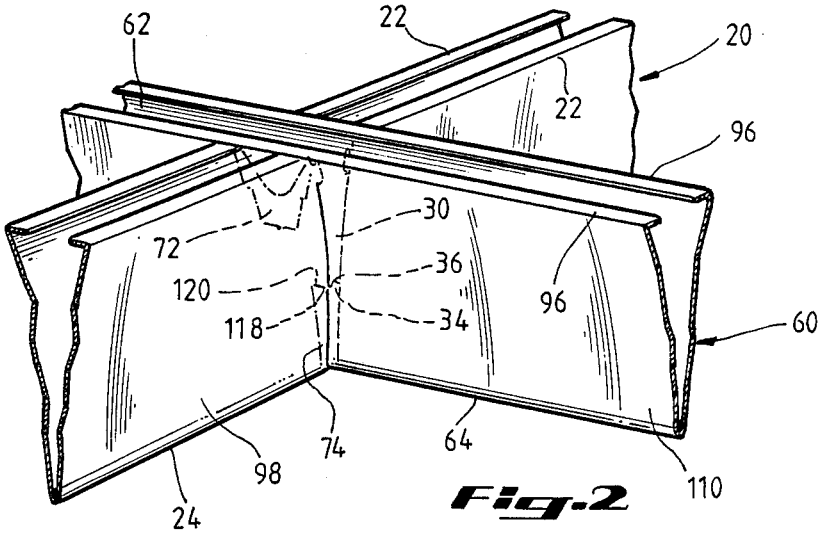
Fig.2
Fig.3
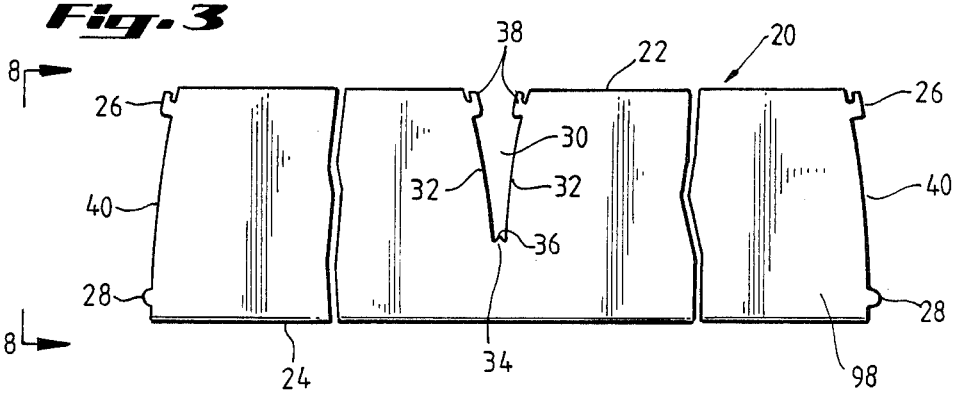

Fig. 4
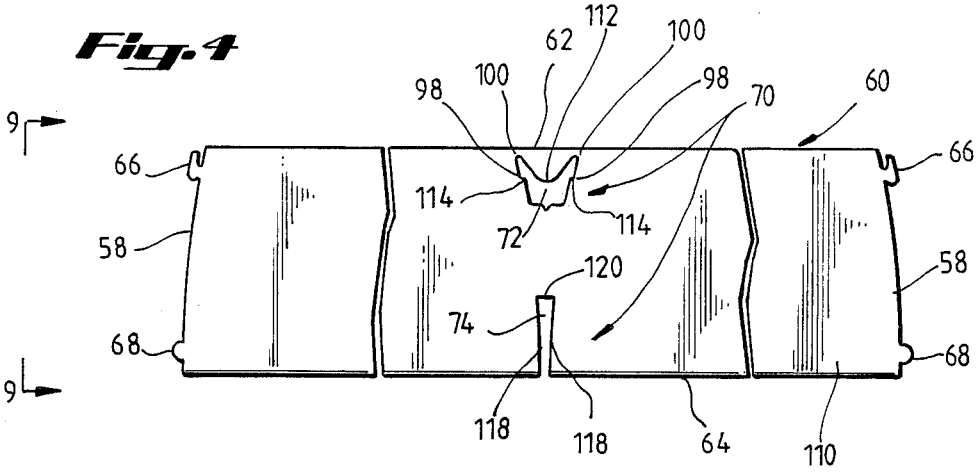
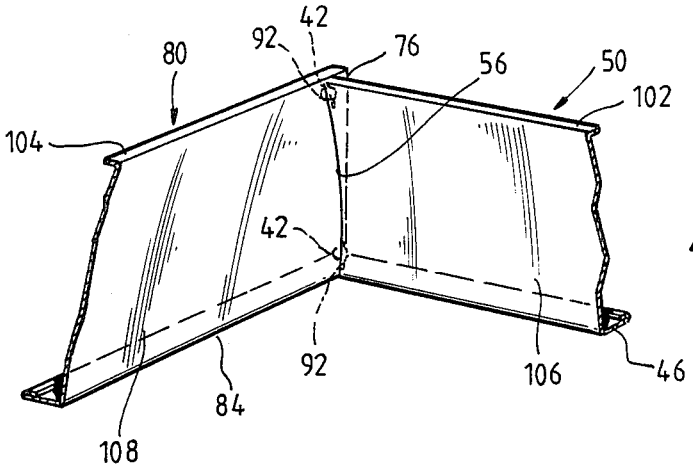
Fig. 5
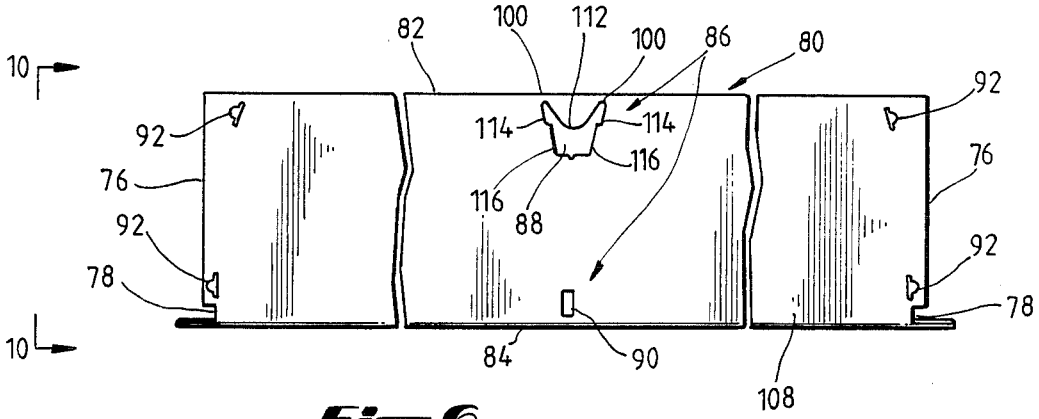
Fig. 6

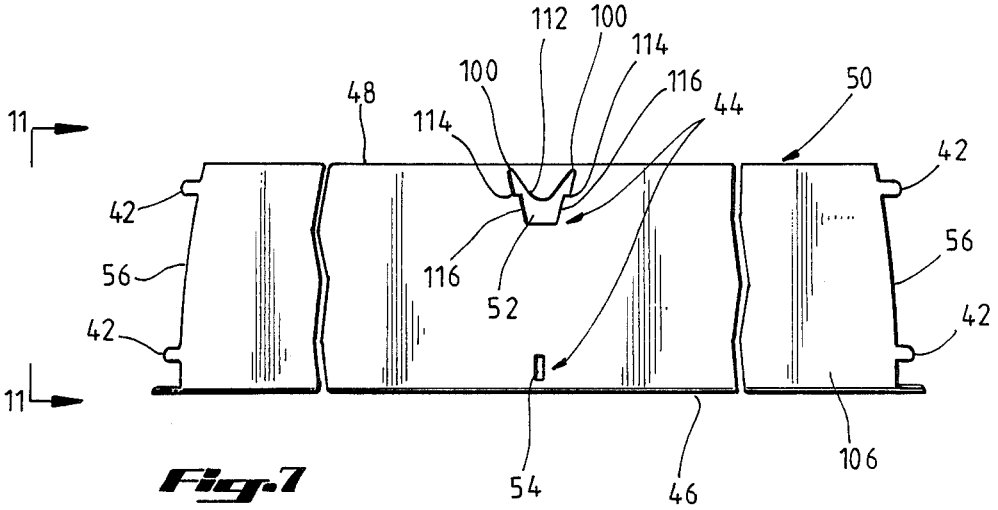
Fig.7
Fig.8
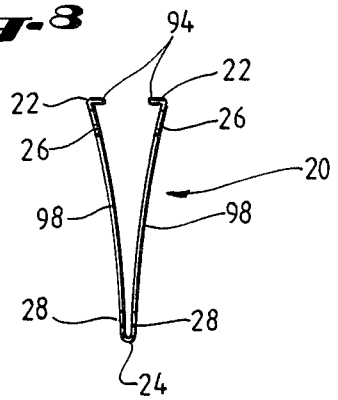
Fig.9
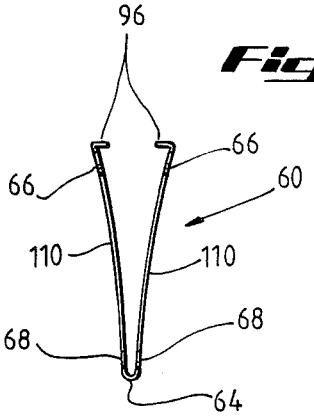
Fig.10
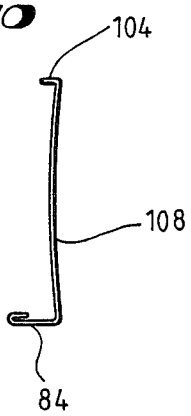
Fig.11
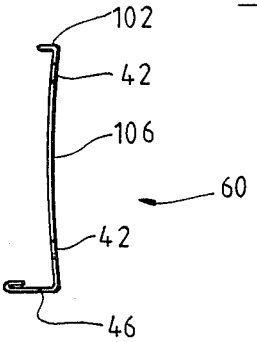

REFLECTIVE LOUVRE FOR CEILING FIXTURES

BACKGROUND OF THE INVENTION

The present invention relates generally to a lighting fixture and in particular to an improvement in such a fixture for use primarily with florescent lights.

Florescent lighting fixtures are a common means of providing light in office buildings, schools, and other structures. While florescent lighting tubes are an efficient means of providing light, the tubes themselves are aesthetically undesirable and are therefore almost always at least partially concealed behind a reflective device.

The reflective device used to conceal the florescent lighting tubes should preferably meet two criteria. First, the device itself must be aesthetically pleasing. Second, the device must have light-reflective qualities so that the device may enhance, rather than diminish, the lighting ability of the florescent tubes.

While many such reflective devices are known in the art, a reflective device called a louvre has been especially popular in the interior design of office buildings and similar structures. Louvres are generally formed from any metallic material that may provide a highly reflective surface. Typically, louvres may be formed from an aluminum compound which may provide polished surfaces able to reflect the light provided by florescent tubes.

Although louvres have been a popular way to fulfill the need for a reflective device to be used in connection with a lighting fixture, the louvres known in the art have several disadvantages. Initially, assembly of louvres typical of those known in the art has been very labor-intensive and therefore expensive to manufacture.

In addition, the louvres known in the art are generally comprised of a number of individual components which must engage and interlock to produce a single reflective device. The seams formed by the juncture of these separate components are often inexact.

When a louvre is installed into a florescent lighting fixture, the junction of each member of the louvre, and therefore each seam, is exposed and is clearly visible. If the seams are inexact and are flawed by gaps, or if the seams pinch or deform the material of the members immediately adjacent to the seam, the aesthetic quality of the louvre is greatly diminished. Further, the reflective ability of a louvre having inexact and flawed seams is significantly reduced.

Thus, prior art louvres have demonstrated various disadvantages which have heretofore not been overcome.

SUMMARY OF THE INVENTION

The present invention overcomes the previously unsolved problems with the prior art and provides a reflective louvre which may be assembled in a fraction of the time normally required for assembly of louvres known in the art. Further, the present invention provides a louvre which is distinguished by exact, tight-fitting, and aesthetically-pleasing seams at the junction of all louvre components.

In accordance with the present invention, a reflective louvre is comprised of different longitudinal components, or members, which intersect at substantially right angles. Contrary to the cumbersome methods of interlocking these components which are known in the art, the components of a louvre according to the present invention merely snap together to provide a quick, easy, and efficient means of assembling the louvre.

Each longitudinal and transverse member is provided with a pair of curved reflecting surfaces. Similarly, each side member of a louvre according to the present invention is provided with a reflective curved surface.

The ends of each longitudinal and transverse member are inwardly curving. Further, each longitudinal member is provided with a plurality of V-shaped grooves with diverging curved edges. Each transverse member and side member is provided with a plurality of corresponding pairs of notches with curved edges.

In order to assure the formation of uniform, tightly sealed, and aesthetically-pleasing seams, it is an important feature that each curved surface of each member of a louvre according to the present invention is defined by the same curve.

In a preferred embodiment of the present invention, a first intersecting member having a pair of interconnected legs is generally in the form of a "V-shape" in cross section. A second interlocking member is also formed with a pair of interconnecting legs so that the member is also generally V-shaped when taken in cross section.

In this embodiment of the present invention, the first intersecting member has at least one pair of mating slots positioned one in each of its legs in general alignment with each other, each slot having a generally converging configuration from its top towards its bottom. Further, a camming structure is provided at the bottom of each slot for engaging a surface on the legs of the second interlocking member. Each slot is also provided with locking means located near the top of each slot for engaging and interlocking with a portion of the legs of the second interlocking member.

In accordance with this embodiment of the present invention, the second interlocking member also has a first pair of mating slots positioned one at the bottom of each of its legs. The first pair of slots are in general alignment with each other and have a generally diverging configuration from the bottom of the legs upwardly. In accordance with this embodiment of the present invention, each second member also has a second pair of mating slots located near the tops of the legs. Again, these second slots are in general alignment with each other, these slots having a complimentary configuration for receiving and engaging the locking means of the first member.

When assembling a louvre according to this embodiment of the present invention, the first pair of mating slots in the second member receives and fits over that portion of the legs of the first member which are immediately below the bottom of the slots in that first member. The camming structure in the first member engages a portion of the legs at the top of the first slots of the second member, thereby urging the legs outwardly to form a more aesthetically pleasing seam at the junction of these members. The locking means of the first member is received by, ad engages with, the second slots of the first member thereby interlocking these members together at substantially right angles.

The present invention also includes a method aspect which involves the aligning and interlocking of the members.

BRIEF DESCRIPTION OF THE DRAWINGS

FIG. 1 is an overall perspective view of a reflective louvre according to the present invention.

FIG. 2 is a perspective view of the seam formed by the junction of two members incorporating the present invention.

FIG. 3 is a side view of a longitudinal member incorporating the present invention.

FIG. 4 is a side view of a transverse member incorporating the present invention.

FIG. 5 is a perspective view of the junction of a longitudinal side member and a transverse side member according to the present invention.

FIG. 6 is a side view of a longitudinal side member incorporating the present invention.

FIG. 7 is a side view of a transverse side member incorporating the present invention.

FIG. 8 is an end view of the longitudinal member depicted in FIG. 3.

FIG. 9 is an end view of the transverse member depicted in FIG. 4.

FIG. 10 is an end view of the longitudinal side member depicted in FIG. 6.

FIG. 11 is an end view of the transverse side member depicted in FIG. 7.

DETAILED DESCRIPTION OF THE PREFERRED EMBODIMENT

Referring to FIG. 1, a louvre 120 according to the present invention is comprised of four different types of components: longitudinal members 20; transverse members 60; longitudinal side members 80; and transverse side members 50.

The details of the longitudinal members will be discussed first. Referring to FIGS. 2 and 3, each longitudinal member 20 is defined by a pair of parallel top surfaces 22, a bottom edge 24, and a pair of symmetrical inwardly-curving ends 40. Each end 40 curves inwardly toward the top 20 so that the bottom 24 of each longitudinal member 20 is longer than the top 22 of each member 20.

FIG. 8 illustrates that each longitudinal member 20 is in the form of a "V-shape", with the legs of the V being formed by upwardly directed curving surfaces 98. These curving surfaces 98 may be, but are not limited to, parabolic surfaces. The bottom 24 of each longitudinal member 20 constitutes the bottom of the "V", and is formed by the intersection of the upwardly directed parabolic surfaces 98. Parabolic surfaces 98 diverge from the bottom 24 of each longitudinal member 20 toward the top 22 of each member 20. The top 22 of each longitudinal member 20 is further defined by a substantially horizontally directed surface 94 extending inwardly from each parabolic surface 98.

Referring again to FIG. 3, each end 40 is provided with a tab 28 and a hooking surface 26. Further, a plurality of uniformly spaced V-shaped grooves 30 are formed throughout the midsection of each longitudinal member 20. The centerline of each groove 30 is substantially perpendicular to the longitudinal centerline of the longitudinal member 20 and is formed in both upwardly directed parabolic surfaces 98. Each groove 30 is defined by a pair of diverging parabolic edges 32 which intersect to form a groove base 34.

The lateral distance between adjacent parabolic edges 32 of separate grooves 30 is the same as the distance between an end 40 of member 20 and the first adjacent parabolic edge 32. Each groove base 34 is provided with an upwardly directed positioning nipple 36. As illustrated, the nipple 36 is in the form of an inverted "V", for purposes that will be more fully explained later. Each edge 32 also includes a hooking surface 38 located proximate the top 22 of the longitudinal member 20. As illustrated, each hooking surface 38 is positioned in opposing fashion to the other hooking surface associated with the opposing surface 32.

The transverse side member will now be discussed. Referring to FIG. 7, each transverse side member 50 is defined by a top 48, a base 46, and a pair of symmetrical ends 56. FIG. 11 illustrates that base 46 is outwardly directed as a flange and that an upwardly directed reflective surface 106 extends from the base to the top. Reflective surface 106 is an inwardly-curving surface. Thus, when a louvre according to the present invention is assembled, the base 46 of each transverse side member 50 will be directed away from the center of the louvre; similarly, the center of the curve which defines reflective surface 106 will be located proximate the center of the louvre, or inward.

It is an important feature of a louvre according to the present invention that the curve defining reflective surface 106 of each transverse side member 50, and the curves defining upwardly directed curving surfaces 98 of each longitudinal member are all substantially identical curves. This provides an aesthetically-pleasing seam created by the juncture of these members when a louvre according to the present invention is assembled. For example, if the upwardly directed curving surfaces 98 are defined by parabolas, each upwardly directed curving surface and each reflective surface of each component will be defined by identical parabolas.

Referring again to FIG. 7, each transverse side member 50 is provided with a plurality of corresponding pairs of notches 44 formed throughout its midsection. Each corresponding pair of notches 44 includes an upper notch 52 and a lower notch 54. Each upper notch 52 is located proximate the top 48 of a transverse side member 50 while each lower notch 54 is located proximate the base 46 of the transverse side member 50.

Each upper notch 52 is configured to receive hooking surfaces 26 of an end 40 of a longitudinal member 20 shown in FIG. 3. Similarly, lower notch 54 is configured to receive a pair of tabs 28 of the same end 40 of the longitudinal member 20. Each upper notch 52 is defined in part by an upper surface 112 and opposed side surfaces 116. Each side surface 116 is provided with a shoulder 114.

When assembling a louvre according to the present invention, upwardly directed curving surfaces 98 of a longitudinal member 20 are urged toward one another, thereby slightly compressing the top 22 of the longitudinal member 20. Hooking surfaces 26 of an end 40 of the longitudinal member 20 are then inserted into upper notch 52 of a transverse side member 50. Hooking surfaces 26 are initially inserted into upper notch 52 below opposed shoulders 114. Upwardly directed curving surfaces 98 are then released. The resiliency of the metallic material forming longitudinal member 20 will then urge the exterior surfaces of hooking surfaces 26 against side surfaces 116.

Longitudinal member 20 is then displaced upwardly relative to transverse side member 50 until hooking surfaces 26 of longitudinal member 20 are seated above the shoulders 114 of the upper notch 52 of the transverse side member 50. The "hook" of each hooking surface 26 of longitudinal member 20 is thereby positioned behind a corner 100, formed by the intersection of upper surface 112 and a side surface 116 of the upper notch 52; each hooking surface 26 is also retained in upper notch 52 by a shoulder 114.

Upper notch 52 and lower notch 54 of transverse side member 50 are distally spaced from one another so that when hooking surfaces 26 of an end 40 of a longitudinal member 20 are seated between corners 100 and shoulders 114 of upper notch 52, the tabs 28 of longitudinal member 20 are located adjacent to lower notch 54 of transverse side member 50. Tabs 28 may therefore be inserted into lower notch 54 and deformed against the outer side of reflective surface 106, thereby interlocking longitudinal member 20 and transverse side member 50 at substantially right angles.

The details of the transverse member will now be discussed. Referring to FIGS. 4 and 9, each transverse member 60 of a louvre according to the present invention is defined by a top 62, a bottom 64, and a pair of symmetrical inwardly curving ends 58. Each end 58 curves inwardly and upward toward the top 62 of the transverse member 60 so that the bottom 64 of the transverse member 60 is longer than the top 62. In cross section, each transverse member 60 is in the form of an elongated "V-shape", with each leg of the V being formed by a pair of upwardly directed curving surfaces 110. The bottom 64 of the transverse member 60 is formed by the intersection of the upwardly directed curving surfaces 110. The top 62 of the transverse member 60 is further defined by a substantially horizontal surface 96 extending inwardly from the top of each upwardly directed curving surface 110.

Referring again to FIG. 4, each end 58 of each upwardly directed curving surface 110 is provided with a hooking surface 66 and a tab 68. Each transverse member 60 is also provided with a plurality of uniformly spaced pairs of corresponding notches 70. Each corresponding pair of notches 70 is comprised of an upper notch 72 and a lower notch, or groove, 74. Upper notch 72 is identically similar to the above-mentioned upper notch 52. Lower notch 74 is partially defined by curving edges 118. The lateral distance between each adjacent curving edge 118 of separate corresponding pairs of notches 70 is the same as the distance between an end 58 and the first adjacent curving edge 118. Each curving edge 118 is configured to match and engage the exterior surface of an upwardly directed curving surface 98 of a longitudinal member 20. Therefore, the curve defining each curving edge 118 is the same curve that defines each upwardly directed curving surface 98.

Referring now to FIGS. 2, 3, and 4, when the longitudinal and transverse members of a louvre according to the present invention are assembled, upwardly directed curving surfaces 110 of a transverse member 60 are urged toward one another, thereby slightly compressing the top 62. Similarly, upwardly directed curving surfaces 98 of a longitudinal member 20 are urged toward one another. Lower notch 74 of the transverse member 60 is then positioned in a groove 30 of the longitudinal member 20. Opposed upwardly directed curving surfaces 98 of longitudinal member 20 are then progressively inserted into lower notch 74 of the transverse member 60 until positioning nipple 36 of longitudinal member 20 contacts the top 120 of the lower notch 74 of the transverse member 60.

As opposed upwardly directed curving surfaces 98 of longitudinal member 20 are inserted into lower notch 74 of the transverse member 60, but before positioning nipple 36 contacts the lower notch top 120, opposed hooking surfaces 38 of longitudinal member 20 are inserted into each upper notch 72 in each upwardly directed curving surface 110 of the transverse member 60. The upwardly directed curving surfaces 98 and 110 are then released, allowing hooking surfaces 38 of longitudinal member 20 to be seated between corners 100 and shoulders 114 of each upper notch 72 of the transverse member 60. Each corresponding upper notch 72 and lower notch 74 are distally spaced so that when the hooking surfaces 38 of the longitudinal member 20 are seated between the corners 100 and the shoulders 114 of each upper notch 72, positioning nipples 36 are positioned between lower notch tops 120 of each lower notch 74.

As will be appreciated by one skilled in the art, the inverted "V" configuration of the nipples 36 provide camming surfaces which engage notch tops 120 to urge that portion of surfaces 110 outwardly for assisting in establishing and maintaining an aesthetically pleasing seam which minimizes the loss of light. Longitudinal members 20 and transverse members 60 thereby interlock at substantially right angles.

The details of the longitudinal side member will now be discussed. Referring to FIG. 6, a longitudinal side member 80 used in assembling a louvre according to the present invention is defined by a top 82, a base 84, and opposed symmetric ends 76. Each longitudinal side member 80 is provided with a pair of end notches 92 proximate each end 76 of the member 80 and a plurality of corresponding notches 86 uniformly spaced throughout the midsection of the member 80. Corresponding notches 86 are substantially identical to the corresponding notches 44 of a transverse side member 50.

Referring now to FIG. 10, each longitudinal side member is comprised of an outwardly directed base 84 and an upwardly directed curving reflective surface 108. Reflective surface 108 is identically similar to reflective surface 106 of transverse side member 50.

Referring now to FIGS. 4, 6, and 7, when assembling a reflective louvre according to the present invention, an end 58 of a transverse member 60 is inserted into corresponding notches 86 of a longitudinal side member 80 in a manner substantially identical to the manner in which an end 40 of a longitudinal member 20 intersects and interlocks with a transverse side member 50. Additionally, an end 56 of a transverse side member 50 is positioned adjacent to an end 76 of a longitudinal side member 80 so that the tabs 42 are aligned with the notches 92 in the end 76 of the longitudinal side member 80. Tabs 42 of transverse side member 50 are inserted into notches 92 of the longitudinal side member 80 and deformed against the exterior of the upwardly directed reflective surface 108, thereby interlocking the transverse side member 50 with the longitudinal side member 80. It will be understood by one skilled in the art that the bases 46 and 84 of transverse side member 50 and longitudinal side member 80 are both directed away from the center of the louvre while the curving reflective surfaces 108 and 106 of the longitudinal side member 80 and the transverse side member 50 are directed toward the center of the louvre. Further, according to the present invention bases 46 and 84 may be conveniently configured to engage and form an aesthetically-pleasing seam when ends 56 and 76 are interlocked.

Referring now to FIGS. 2–11, when assembling a louvre according to the present invention, a plurality of transverse members 60 are interlocked with a plurality of longitudinal members 20 in the manner described above. Each groove 30 of each longitudinal member 20 interconnects with a portion of a transverse member 60. In a preferred embodiment of the present invention, two longitudinal members 20 are positioned parallel to one another so that five grooves 30 in a member 20 are aligned with five grooves 30 in the other longitudinal members 20. Five transverse members 60 are then inserted into a separate groove 30 of each longitudinal member 20 and interlocked, thereby forming the interior of a louvre according to the present invention.

A first transverse side member 50 is then positioned perpendicularly to the plurality of longitudinal members 20. Each corresponding pair of notches 44 is aligned with a separate end 40 of a separate longitudinal member 20. Each end 40 of the several longitudinal members 20 is then inserted into its respective pair of corresponding notches 44 and interlocked in the manner described above.

A first longitudinal side member 80 is then positioned perpendicularly to the plurality of transverse members 60 and the first transverse side member 50. The first longitudinal side member 80 is positioned so that each corresponding pair of notches 86 is aligned with a separate end 56 of a transverse side member 50 and a pair of end notches 92, formed in longitudinal side member 80, are aligned with the tabs 42 of an end 56 of the first transverse side member 50. The hooking surfaces 66 and tabs 68 of each of the transverse members 60 are then inserted into their respective pair of notches 86 in the first longitudinal side member 80 and interlocked in the manner described above. Similarly, the tabs 42 of the end 56 of the first transverse side member 50 are inserted into notches 92 and deformed against the exterior of reflective surface 108 of the first longitudinal side member 80, thereby interlocking the first transverse side member 50 and the first longitudinal side member 80 together.

A second transverse side member 50 is then positioned opposite the first transverse side member 50, perpendicular to the plurality of longitudinal members 20. Again, each free end 40 of each longitudinal member 20 is aligned with a separate corresponding pair of notches 44. Tabs 42 of the second transverse side member 50 are aligned with notches 92 of the first longitudinal side member 80. Tabs 42 of the second transverse side member 50 are inserted into notches 92 of the first longitudinal side member 80. Each set of hooking surfaces 26 and tabs 28 of each individual longitudinal member 20 are inserted into their respective corresponding pair of notches 44 in the second transverse side member 50 and interlocked in the manner described above.

Finally, a second longitudinal side member 80 is positioned opposite the first longitudinal side member 80, and is positioned perpendicularly to each transverse member 60 and both transverse side members 50. Notches 92 formed in each end 76 of the second longitudinal side member 80 are aligned with the tabs 42 on the free end 56 of the first and second transverse side members 50. Similarly, each corresponding pair of notches 86 in the second longitudinal side member 80 are aligned with a separate end 58 of a transverse member 60. As before, each pair of hooking surfaces 66 and tabs 68 of each end 58 of each transverse member 60 are inserted into a separate pair of corresponding notches 86 in the second longitudinal side member 80 and interlocked as described above. The tabs 42 of the first and second transverse side members 50 are simultaneously inserted into their corresponding notches 92 in the second longitudinal side member 80 and deformed against the exterior of the reflective surface 108, thereby creating a single reflective louvre.

The louvre may then be attached to a lighting fixture installed in a structure.

Various modifications and improvements may be made to the disclosed embodiment without departing from the overall scope and spirit of the invention. For example, different interlocking arrangements could be provided on the ends of the various members, or the curved surfaces could be modified so as to be parabolic or substantially planar.

Having therefore fully and completely disclosed the best mode of my invention, I now claim:

1. A reflective louvre, adapted for use in a lighting fixture, comprising:

a plurality of reflective elongated longitudinal members, each said longitudinal member having generally a V-shape in cross section defined by a pair of interconnected diverging legs, each leg of said V being formed by an upwardly directed curving surface, each longitudinal member having a top and a bottom, each said bottom being formed by the intersection of upwardly directed curving surfaces, each longitudinal member having at least one groove substantially perpendicular to the longitudinal centerline of said member formed throughout the midsection of said member, each said groove having at least one pair of hooking surfaces; and a plurality of reflective elongated transverse members, each said transverse member having generally a V-shape in cross section defined by a pair of interconnected diverging legs, each leg of said V being formed by an upwardly directed curving surface, each said transverse member having a top and a bottom, each bottom being formed by the intersection of the upwardly directed curving surfaces, each transverse member having at least one pair of corresponding notches in each said curving surface throughout the midsection of said member, adapted to perpendicularly receive an inserted portion of a said longitudinal member, each said corresponding pair of notches comprising an upper "U" shaped notch located proximate the top of said member and adapted to receive at lest a pair of hooking surfaces, and a lower rectangular notch proximate the bottom of said member.

2. The louvre according to claim 1 wherein each said end of each said upwardly directed curving surface of each said longitudinal and transverse member defines a parabolic curve and is provided with at least one hooking surface proximate said top of said member and at least one tab proximate said bottom of said member, each said hooking surface and each said tab being engagable with a pair of notches in a separate side member so that said members interlock; and wherein each said curved surface of each said longitudinal member, transverse member, and side member define parabolas identical to the parabola defined by said ends of said members.

3. The louvre according to claim 2 wherein each said groove in each said longitudinal member extends from said top of said longitudinal member to a groove base located at a point at least halfway between said top and said bottom of said longitudinal member, said groove being provided in each said upwardly directed curving parabolic surface of said longitudinal member, said groove also having an upwardly directed positioned nipple formed in said notch base to guide said transverse member and urge said upwardly directed curving parabolic surfaces of said transverse member apart when said transverse member is inserted into said longitudinal member; said edges defining said groove further defining parabolic surfaces substantially identical to said parabolic curving surface of said transverse member.

4. The louvre according to claim 1 wherein at least one said transverse member is insertable into a separate groove in at least one longitudinal member so that the longitudinal and transverse members engage and interlock at substantially right angles thereby creating uniform curved seams at their juncture.

5. The louvre according to claim 2 wherein both the longitudinal members and the transverse members have symmetrical parabolically shaped ends and further comprising:

a plurality of rectangular, elongated longitudinal side members, each longitudinal side member having an inner side and an outer side, said inner side being directed toward said longitudinal and transverse members, said outer side being directed away from said longitudinal and transverse members, each said longitudinal side member having an outwardly directed base and an upwardly directed parabolic reflective surface, each longitudinal side member having symmetric ends and a plurality of corresponding upper and lower notches throughout the midsection of said upwardly directed reflective surface, each said pair of upper and lower notches being engagable with a said end of a said transverse member so that said end of said transverse member joins and abuts said reflective parabolic surface of said side member; and a plurality of rectangular, elongated transverse side members, each said transverse side member having an inner side and an outer side, said inner side being directed toward said longitudinal and transverse members, said outer side being directed away from said longitudinal and transverse members, each said transverse side member having an outwardly directed base and an upwardly directed parabolic reflective surface, each said transverse member having symmetric ends and a plurality of corresponding upper and lower notches through the midsection of said upwardly directed reflective surface, each said pair of upper and lower notches being engagable with a said end of a said longitudinal member so that said end of said longitudinal member joins and abuts said reflective parabolic surface of said side member.

6. The louvre according to claim 5 wherein each said longitudinal member has inwardly curving, parabolically shaped, ends adapted to perpendicularly engage said upwardly directed reflecting surface of said transverse side member, said inwardly curving end being formed such that said bottom of each said longitudinal member is longer than the said top of each said longitudinal member.

7. The louvre according to claim 5 wherein each said transverse member has inwardly curving, parabolically shaped, ends adapted to perpendicularly engage said upwardly directed reflecting surface of said longitudinal member, said inwardly curving end being formed such that said bottom of each said transverse member is longer than the said top of each said transverse member.

8. The louvre according to claim 5 wherein each said end of each said transverse side member is inwardly curving and adapted to perpendicularly engage said upwardly directed reflective surface of said longitudinal side member, each said end being provided with at least one tab, said tab being engagable with a notch in said longitudinal side member so that said longitudinal and transverse side members interlock.

9. The louvre according to claim 5 wherein a pair of said longitudinal side members and a pair of transverse side members engage and frame a plurality of interlocked longitudinal and transverse members to create a single reflective louvre.

10. A method of producing a reflective louvre, adapted for use in a lighting fixture, comprising the steps of:

forming a plurality of V-shaped, elongated longitudinal members, each said member having a top and a bottom, each leg of said V being formed by an upwardly directed curving reflective surface, said bottom of each said member being formed by the intersection of said upwardly directed curving reflective surfaces, each said member having symmetrical ends;

forming a plurality of uniformly spaced V-shaped grooves throughout the midsection of said longitudinal members, each said groove being formed in both of said upwardly directed curving reflective surfaces of each said longitudinal member, each said groove extending from said top of each said longitudinal member to a groove base located at a point at least halfway between said top and said bottom of said longitudinal member, each edge of each said V-shaped groove having a hooking surface, said groove base having an upwardly directed positioning nipple;

forming a plurality of V-shaped, elongated transverse members, each said member having a top and a bottom, each leg of said V being formed by an upwardly directed curving reflective surface, each said bottom of each said member being formed by the intersection of said upwardly directed curving reflective surfaces, each said member having symmetrical ends;

forming a plurality of uniformly spaced, corresponding pairs of notches throughout the midsection of said transverse member, each said pair of notches comprising an upper notch, proximate the top of said member, and a lower notch, proximate the bottom of said member, each said upper notch being adapted to engage said hooking surfaces of said groove of said longitudinal members, each said lower notch adapted to engage the lower exterior surface of a said longitudinal member, so that said longitudinal and transverse members interlock at substantially right angles;

forming a plurality of longitudinally side members, each said longitudinal side member having an inner side and an outer side, each said longitudinal side member having an outwardly directed base and an upwardly directed reflecting surface, each said member having symmetrical ends;

forming a plurality of uniformly spaced, corresponding pairs of notches throughout the midsection of each said longitudinal side member, each said pair of notches comprising an upper notch, engagable with the said top of a said end of a said transverse member, and a lower notch, proximate said base and engagable with the said bottom of a said end of a said transverse member, such that a said transverse member and a said longitudinal side member interlock at substantially right angles, said end of said transverse member terminating at said reflective surface of said longitudinal side member;

forming a plurality of transverse side members, each said side member having an inner side and an outer side, each said transverse side member having an outwardly directed base and an upwardly directed reflecting surface, each said member having symmetrical ends;

forming a plurality of uniformly spaced, corresponding pairs of notches throughout the midsection of each said transverse side members, each said pair of notches comprising an upper notch, engagable with the said top of a said end of a said longitudinal member, and a lower notch, proximate said base and engagable with the said bottom of a said end of a said longitudinal member, such that a said longitudinal member and a said transverse side member interlock at substantially right angles, said end of said transverse member terminating at said reflective surface of said transverse side member;

wherein each said upper notch of each said longitudinal side member and each said transverse side member is defined by a lower surface, proximate said base and substantially parallel to said base, an upper surface, and a pair of opposed side surfaces, each said side surface being configured to receive and retain said hooking surfaces of each said end of their respective said transverse members and said longitudinal members;

aligning said plurality of said longitudinal members in a spaced, parallel relationship so that each said end of each said longitudinal member is aligned adjacent to a said pair of corresponding notches in a perpendicularly placed, first transverse side member;

inserting a plurality of said transverse members into said aligned longitudinal members so that each said longitudinal member intersects and interlocks with each said transverse member at substantially right angles;

inserting each said hooking surface of each said longitudinal member into a said upper notch of a transverse member;

interlocking each said longitudinal member with a inserted transverse member;

interlocking each said longitudinal member with said first transverse side member;

aligning a first said longitudinal side member with said ends of said interlocked transverse members so that each said end is aligned with a said pair of corresponding notches and each said transverse member and said first transverse side member intersects said first longitudinal side member at substantially right angles;

inserting each said end of each said interlocked transverse member into said aligned pair of corresponding notches;

interlocking each said transverse member with said first longitudinal side member;

interlocking intersecting corresponding ends of said first longitudinal side member and said first transverse side member;

aligning a second transverse side member opposite said first transverse side member so that said first longitudinal side member and said longitudinal members intersect said second transverse side member at substantially right angles, each said end of each said longitudinal member being aligned with a said pair of corresponding notches in said second transverse side member;

inserting each said end of each said longitudinal member into said corresponding notches in said second transverse side member;

interlocking each said longitudinal member with said second transverse side member;

interlocking said intersecting ends of said second transverse side member and said first longitudinal side member;

aligning a second longitudinal side member opposite said first longitudinal side member so that said first transverse side member, said second transverse side member, and said transverse members intersect said second longitudinal side member at substantially right angles, each said end of each said transverse member being aligned with a said pair of corresponding notches in said second longitudinal side member;

inserting each said end of each said transverse member into said corresponding notches in said second longitudinal side member;

interlocking each said transverse member with said second longitudinal side member; and interlocking said intersecting ends of said first transverse side member, said second transverse side member, and said second longitudinal side member in order to produce a single reflective louvre unit, said tops and said bottoms of each said interlocked member corresponding with the tops and bottoms of all other members so that all said tops and bottoms of all said members are aligned in a uniform vertical relationship, with all said tops being in one vertical plane and all said bottoms being in a second parallel plane.

11. The method according to claim 10 wherein each said upwardly directed curving surface of each said longitudinal member and each said transverse member is defined by a substantially identical parabola.

12. The method according to claim 11 wherein each said groove in each said longitudinal member is defined by a pair of diverging parabolic surfaces, the greatest divergence of which occurs at said top of said longitudinal member, said parabolic surfaces being defined by a parabola substantially identical to the parabola which defines said upwardly directed parabolic surfaces of each said transverse member.

13. The method according to claim 11 wherein the said upwardly directed reflecting surface of each said longitudinal side member and each said transverse side member is defined by an inwardly directed parabola substantially identical to the parabola which defines said upwardly directed parabolic surfaces of said longitudinal and transverse members.

14. The method according to claim 11 wherein each said lower notch of each said corresponding pair of notches formed in each said transverse member is defined by a groove extending from said bottom of each said member less than halfway through the width of each said member, each said groove being defined by a pair of diverging parabolic surfaces the least divergence of which occurs at the said bottom of each said member, each said parabolic surface being defined by a parabola substantially identical to the said parabola which defines said upwardly directed parabolic surfaces of each said longitudinal member.

15. The method according to claim 11 wherein said ends of said longitudinal members, said transverse members, and said transverse side members are defined by a common parabola substantially identical to the said parabola which defines said upwardly directed parabolic surfaces of said longitudinal and transverse members.

16. A method of producing a reflective louvre, adapted for use in a lighting fixture, comprising the steps of:

forming a plurality of V-shaped, elongated longitudinal members, each said member having a top and a bottom, each leg of said V being formed by an upwardly directed curving reflective surface, said bottom of each said member being formed by the intersection of said upwardly directed curving reflective surfaces, each said member having symmetrical ends;

forming a plurality of uniformly spaced V-shaped grooves throughout the midsection of said longitudinal members, each said groove being formed in both of said upwardly directed curving reflective surfaces of each said longitudinal member, each said groove extending from said top of each said longitudinal member to a groove base located at a point at least halfway between said top and said bottom of said longitudinal member, each edge of each said V-shaped groove having a hooking surface, said groove base having an upwardly directed positioning nipple;

forming a plurality of V-shaped, elongated transverse members, each said member having a top and a bottom, each leg of said V being formed by an upwardly directed curving reflective surface, each said bottom of each said member being formed by the intersection of said upwardly directed curving reflective surfaces, each said member having symmetrical ends;

forming a plurality of uniformly spaced, corresponding pairs of notches throughout the midsection of said transverse member, each said pair of notches comprising an upper notch, proximate the top of said member, and a lower ntoch, proximate the bottom of said member, each said upper notch being adapted to engage said hooking surfaces of said groove of said longitudinal members, each said lower notch adapted to engage the lower exterior surface of a said longitudinal member, so that said longitudinal and transverse members interlock at substantially right angles;

forming a plurality of longitudinal side members, each said longitudinal side member having an inner side and an outer side, each said longitudinal side member having an outwardly directed base and an upwardly directed reflecting surface, each said member having symmetrical ends;

forming a plurality of uniformly spaced, corresponding pairs of notches throughout the midsection of each said longitudinal side member, each said pair of notches comprising an upper notch, engagable with the said top of a said end of a said transverse member, and a lower notch, proximate said base and engagable with the said bottom of a said end of said transverse member, such that a said transverse member and a said longitudinal side member interlock at substantially right angles, said end of said transverse member terminating at said reflective surface of said longitudinal member;

forming a plurality of transverse side members, each said side member having an inner side and an outer side, each said transverse side member having an outwardly directed base and an upwardly directed reflecting surface, each said member having symmetrical ends;

forming a plurality of uniformly spaced, corresponding pairs of notches throughout the midsection of each said transverse side member, each said pair of notches comprising an upper notch, engagable with the said top of a said end of said longitudinal member, and a lower notch, proximate said base and engagable with the said bottom of a said end of a said longitudinal member, such that a said longitudinal member and a said transverse side member interlock at substantially right angles, said end of said transverse member terminating at said reflective surface of said transverse side member;

wherein each said upper notch of each said longitudinal side member and each said transverse side member is defined by a lower surface, proximate said base and substantially parallel to said base, an upper surface, and a pair of opposed side surfaces, each said side surface being configured to receive and retain said hooking surfaces of each said end of their respective said transverse members and said longitudinal members;

aligning said plurality of said longitudinal members in a spaced, parallel relationship so that each said end of each said longitudinal member is aligned adjacent to a said pair of corresponding notches in a perpendicularly placed, first transverse side member;

inserting a plurality of said transverse members into said aligned longitudinal members so that each said longitudinal member intersects and interlocks with each said transverse member at substantially right angles;

inserting each said hooking surface of each said longitudinal member into a said upper notch of a transverse member;

interlocking each said longitudinal member with a inserted transverse member;

interlocking each said longitudinal member with said first transverse side member;

aligning a first said longitudinal side member with said ends of said interlocked transverse members so that each said end is aligned with a said pair of corresponding notches and each said transverse member and said first transverse side member intersects said first longitudinal side member at substantially right angles;

inserting each said end of each said interlocked transverse member into said aligned pair of corresponding notches;

interlocking each said transverse member with said first longitudinal side member;

interlocking intersecting corresponding ends of said first longitudinal side member and said first transverse side member;

aligning a second transverse side member opposite said first transverse side member so that said first longitudinal side member and said longitudinal members intersect said second transverse side member at substantially right angles, each said end of each said longitudinal member being aligned with a said pair of corresponding notches in said second transverse side member;

inserting each said end of each said longitudinal member into said corresponding notches in said second transverse side member;

interlocking each said longitudinal member with said second transverse side member;

interlocking said intersecting ends of said second transverse side member and said first longitudinal side member;

aligning a second longitudinal side member opposite said first longitudinal side member so that said first transverse side member, said second transverse side member, and said transverse members intersect said second longitudinal side member at substantially right angles, each said end of each said transverse member being aligned with a said pair of corresponding notches in said second longitudinal side member;

inserting each said end of each said transverse member into said corresponding notches in said second longitudinal side member;

interlocking each said transverse member with said second longitudinal side member;

interlocking said intersecting ends of said first transverse side member, said second transverse side member, and said second longitudinal side member in order to produce a single reflective louvre unit, said tops and said bottoms of each said interlocked member corresponding with the tops and bottoms of all other members so that all said tops and bottoms of all said members are aligned in a uniform vertical relationship, with all said tops being in one vertical plane and all said bottoms being in a second parallel plane;

wherein each said upwardly directed curving surface of each said longitudinal and each said transverse member is defined by a substantially identical parabola; and wherein each said upper notch of each said longitudinal side member and each said transverse member is defined by a lower surface, proximate said base and substantially parallel to said base, an upper surface, opposite said lower surface, and a pair of opposed side surfaces, each said side surface being configured to receive and retain said hooking surfaces of each said end of their respective said transverse members and longitudinal members.

* * * * *